US006283413B1

(12) United States Patent
Bukur

(10) Patent No.: US 6,283,413 B1
(45) Date of Patent: Sep. 4, 2001

(54) ROTARY FLYER

(76) Inventor: Thomas J. Bukur, 1455 Mississinew Ct., Valparaiso, IN (US) 46385

( * ) Notice: Subject to any disclaimer, the term of this patent is extended or adjusted under 35 U.S.C. 154(b) by 0 days.

(21) Appl. No.: 09/399,553

(22) Filed: Sep. 20, 1999

Related U.S. Application Data

(63) Continuation-in-part of application No. 08/794,144, filed on Feb. 3, 1997, now Pat. No. 5,954,297, which is a continuation-in-part of application No. 08/421,746, filed on Apr. 13, 1995, now Pat. No. 5,598,988.

(51) Int. Cl.[7] ..... B64C 31/06

(52) U.S. Cl. ..... 244/153 A; 244/153 R

(58) Field of Search ..... 244/17.11, 33, 244/153 R, 153 A, 155 A, 155 R; D21/84, 85, 86, 88

(56) References Cited

U.S. PATENT DOCUMENTS

| | | | |
|---|---|---|---|
| 490,949 | * | 1/1893 | Davis . |
| 3,296,617 | * | 1/1967 | Rogallo . |
| 4,099,690 | * | 7/1978 | Mendelsohn et al. . |
| 4,779,825 | * | 10/1988 | Sams . |
| 4,942,506 | * | 7/1990 | Flory . |
| 5,056,447 | * | 10/1991 | Labrador . |
| 5,183,224 | * | 2/1993 | Harburg . |
| 5,417,390 | * | 5/1995 | Southwick . |
| 5,598,988 | * | 2/1997 | Burkur . |

* cited by examiner

*Primary Examiner*—Charles T. Jordan
*Assistant Examiner*—Tien Dinh
(74) *Attorney, Agent, or Firm*—Patula & Associates, P.C.

(57) ABSTRACT

A rotary flying device comprising an airfoil having an axis of rotation means for rotation thereabout, a stabilizer disk mounted on said airfoil, a bearing assembly means attached to said axis of rotation means, and a bridle means attached to said bearing assembly means for receiving a support line.

13 Claims, 10 Drawing Sheets

150
157
152
170
120
195
196
190
130
180
154
140
135
110
174
100

ROTARY FLYER

The present invention is a continuation-in-part application of U.S. patent application Ser. No. 08/794,144 filed Feb. 3, 1997, now U.S. Pat. No. 5,954,297, which is a continuation-in-part application of U.S. patent application Ser. No. 08/421,746 filed Apr. 13, 1995, now U.S. Pat. No. 5,598,988, and relates to flying devices, particularly a rotary flying device having novel flying and folding characteristics.

BACKGROUND OF THE INVENTION

Flying toys, especially kites, having long been used by all types of people for fun and entertainment. Kites come in all shapes and sizes. One particular type of kite is known as a rotatable airfoil kite. Such kites generally comprise a single elongated airfoil element or wing. This wing contains a circular disk member or stabilizer disk preferably attached at the center portion of the wing.

Various examples of rotatable kites are shown in U.S. Pat. No. 3,079,115 to Edwards, Jr. et al., in U.S. Pat. No. 4,012,017 to Springston, et al., in U.S. Pat. No. 4,121,794 to Lemelson, in U.S. Pat. No. 4,606,518 to Jeffrey, in U.S. Pat. No. 4,779,825 to Sams, and in U.S. Pat. No. 4,790,498 to Jeffrey.

However, these known rotatable kites present several disadvantages to users. Generally, these kites are not very durable and tend to break on impact with the ground or other objects, or even due to a strong wind force. Also, these kites are expensive, cumbersome, hard to assemble, hard to transport, and unstable in flight. Further, these kites are incapable of being flown with tails or streamers.

The present invention solves the problems or disadvantages of known rotatable kites. The invention is lightweight yet very durable. It can be assembled with ease. The invention has a novel characteristic of being foldable for transportation or storage, while at the same time being stable in flight. Alternatively, an inflatable embodiment of the invention allows deflation and folding thereof for easy storage and transportation. The invention is specifically designed to be capable of flying with tails or streamers, and can include various attachments in the form of noise makers and illumination means. The invention can further take various shapes. Further, the invention is inexpensive and easy to fly.

Edwards. Jr. et al. (U.S. Pat. No. 3,079,115) disclose a rotatable kite having a wing and a stabilizer disk. However, the kite is difficult to assemble due to plurality of tabs and slots which must be interconnected. Further, the kite is incapable of being folded or deflated for transportation and makes no provisions for flying with streamers.

Springston, et al. (U.S. Pat. No. 4,012,017) discloses a rotatable kite having a wing and two stabilizer disks. However, the kite is difficult to assemble due to the two disk design, and the need for bracing line. Further, the kite is incapable of being folded or deflated for transportation and makes no provisions for flying with streamers.

Lemelson (U.S. Pat. No. 4,121,794) discloses a relatively simple rotatable kite having a wing and a stabilizer disk. However, the kite is incapable of folding or deflation for transportation and makes no provisions for flying with streamers.

Jeffrey (U.S. Pat. No. 4,606,518) discloses another relatively simple rotatable kite having a wing and a stabilizer disk. However, the kite is incapable of folding or deflating for transportation and makes no provisions for flying with streamers.

Sams (U.S. Pat. No. 4,779,825) discloses various rotatable kites which are complex and difficult to assemble. Sams also discloses the use of cushioning strips covered with hinge tape to allow for movement of the stabilizer disk. However, these strips are used to prevent the disk from folding completely flat against the wing, unlike the present invention which is capable of such folding. Sams' disk is capable of movement during flight, unlike the present invention whose disk is stable during flight. Further, Sams makes no provisions for flying with streamers or deflation.

Jeffrey (U.S. Pat. No. 4,790,498) discloses a rotatable kite having a wing and a stabilizer disk. However, the kite is difficult to assemble due to a pair of closely spaced radially extending support elements. Further, the kite is incapable of folding or deflation and makes no provision for flying with streamers.

BRIEF SUMMARY OF THE INVENTION

The invention consists of an improved rotatable flying kite designed specifically to fly with streamers, noise makers and illumination means, and also to be completely foldable or deflatable for ease in transportation or storage, while at the same time maintaining stable flying characteristics. The invention is manufactured to be durable, lightweight, easy to assemble and repair, and inexpensive, and can take many different shapes.

In order to be able to fly with streamers, the invention utilizes novel three-hold bearings, to which the streamers are attached. The invention is also equipped with means to hold the streamers away from the rotating members of the kite so that they do not become entangled therewith.

The invention, once assembled, is capable of being completely folded when not in use to facilitate transportation. The invention utilizes novel blockers or stabilizing elements to prevent the kite from folding or wobbling during flight. In an alternate embodiment, the invention is easily inflatable and deflatable to allow easy storage and transportation as well as quick set-up.

It is the principle object of the present invention to provide an improved rotatable flying kite.

It is a further object of the present invention to provide streamers or other attachments for a rotatable flying kite.

It is also an object of the present invention to provide a rotatable flying kite capable of being completely folded when not in use, while at the same time maintaining stable flying characteristics.

It is also an object of the present invention to provide an inflatable rotatable flying kite capable of being completely deflated when not in use, while at the same time maintaining stable flying characteristics.

It is also an object of the present invention to provide a rotatable kite with noise makers and/or illumination means.

It is also an object of the present invention to provide a rotatable kite of a variety of different shape.

It is an additional object of the present invention to provide a rotatable flying kite that is lightweight, durable, simple in construction and assembly, easy to repair, and inexpensive.

It is another object of the invention to provide novel three-hole bearings for a rotatable flying kite.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1:
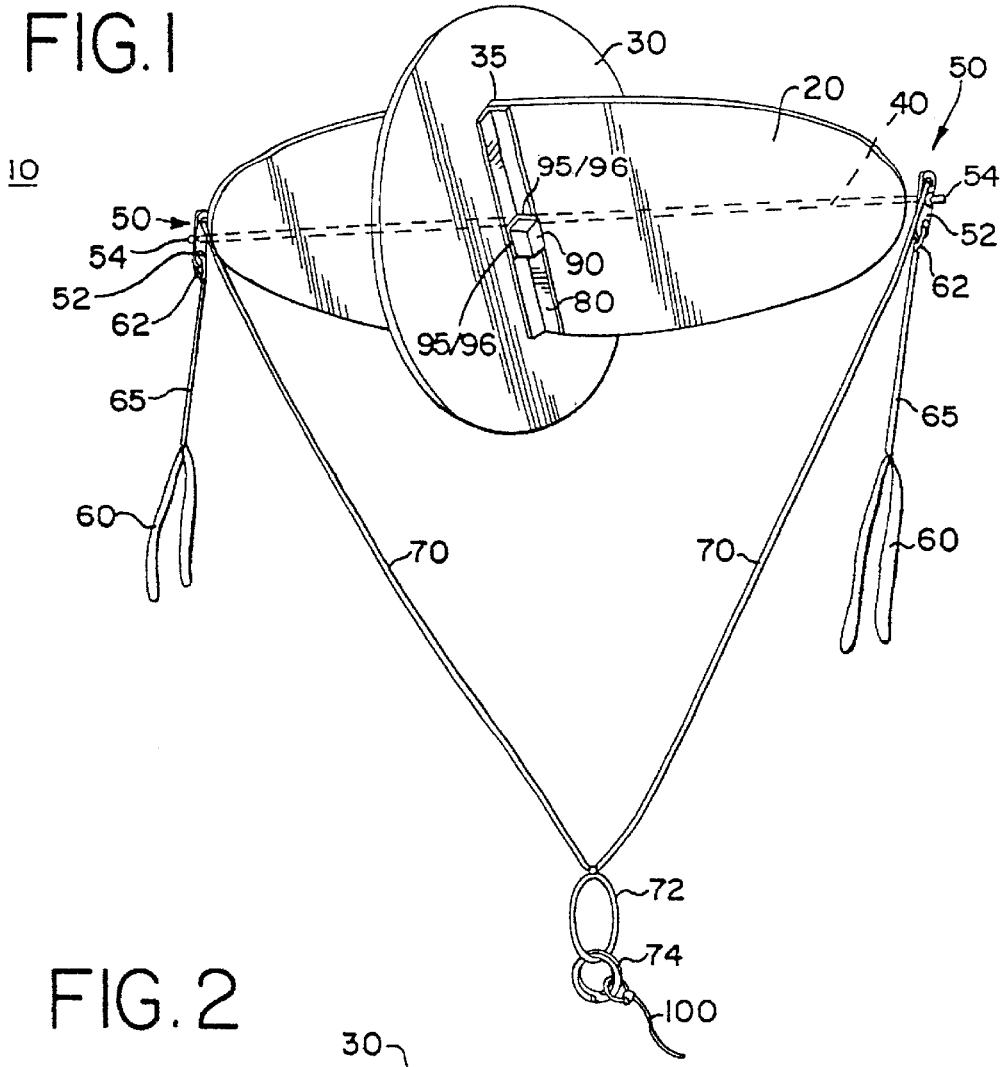
FIG. 1 is a perspective view of the preferred embodiment of the present invention in its flying position.

While the invention is susceptible of embodiment in many different forms, there is shown in the drawings and will be described herein in detail, a preferred embodiment of the present invention. It should be understood, however, that the present disclosure is to be considered an exemplification of the principles of the invention and is not intended to limit the spirit and scope of the invention and/or claims of the embodiment illustrated.

FIGS. 1 through 23 illustrate the present invention 10, as well as alternate embodiments, comprising an airfoil or wing 20 and a stabilizer disk 30. Disk 30 contains a slot 35 for receiving the wing 20. A rigid dowel or rod 40, preferably made of a strong, lightweight material, for example wood or other materials, is attached along the length of the wing 20. Attached to the ends of the rod 40 is bearing assembly 50. Attached to each bearing assembly 50 are the streamers 60 and kite bridle 70.

Referring now to FIG. 1, the invention 10 is shown in its flying position. Wing 20 is oval shaped and is inserted through slot 35 in disk 30. Disk 30 is centered on and perpendicular to wing 20. Wing 20 and disk 30 are preferably made of styrofoam. A layer of poly-coated beaded paper is attached to each side of the wing 20 and disk 30. This paper adds strength to the kite and allows silk screening or decoration of the kite. Alternatively, a layer of plastic film coating is attached to each side of the wing and disk. This plastic film coating is extremely durable, yet flexible.

Figure 10:
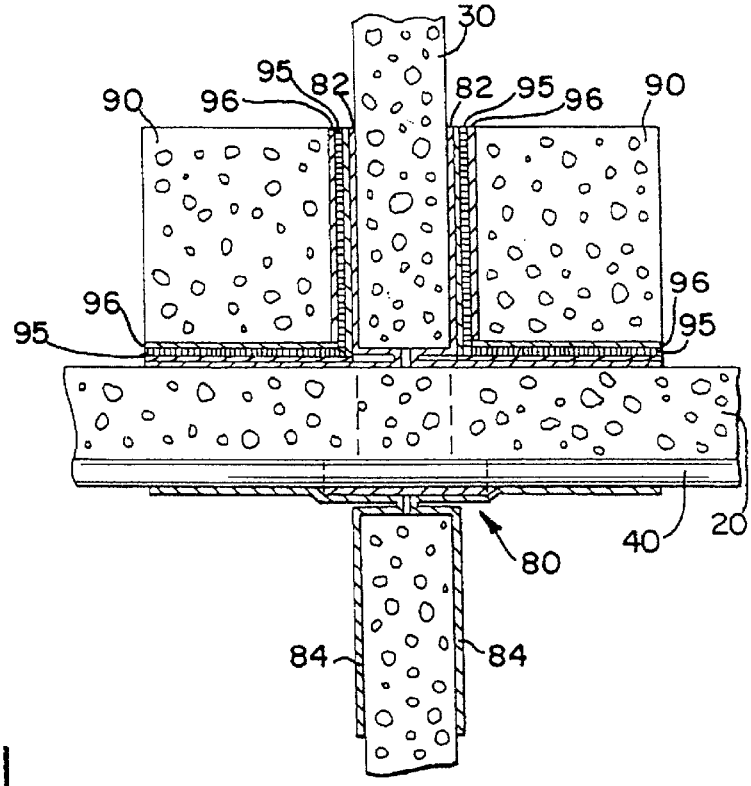
FIG. 10 is a cross-sectional view of the intersection of the airfoil and stabilizer disk of the present invention.

Disk 30 is anchored to wing 20, at their intersection, by connecting means, preferably nylon tape. Nylon tape is strong and easy to work with, however, any suitable tape may be used. Tape 80 is placed along all four quadrants of the intersecting wing 20 and disk 30 to form a double hinge (as seen in FIG. 10). Disk 30 is free to rotate about this double hinge until prevented from doing so by contacting wing 20. To keep disk 30 from rotating during flight, and maintaining a perpendicular orientation to wing 20, two stabilizing elements or blockers 90 are used. Blockers 90 can take any suitable shape such as square, spherical, triangular, etc. Blockers 90 are removably connected by suitable fastening material 95 and 96, such as hook and loop type fasteners, to the wing 20 and disk 30, at the intersection, to prevent disk 30 from rotating about the double hinge. In an alternative embodiment (described in detail below), the wing 20 and disk 30 may each be inflatable bodies, as depicted in FIGS. 14–18, such that the wing 220 and disk 230 are foldable when delfated and rigid when inflated to allow for proper flight of the invention 10 as described herein.

Figure 4:
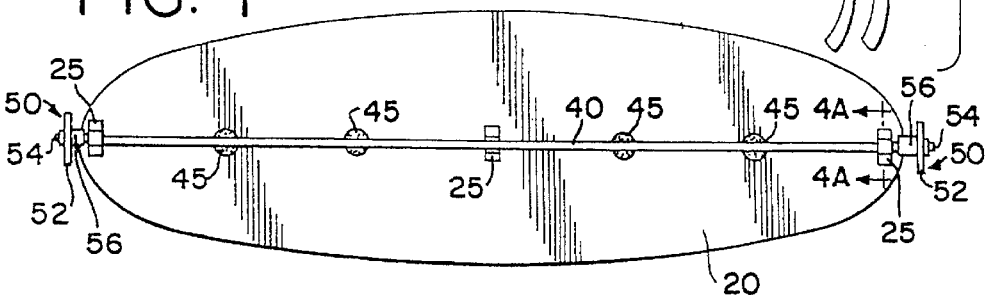
FIG. 4 is a top view of the airfoil of the present invention.

A rod 40 is centered on and attached to wing 20. The rod 40 provides rigidity to wing 20 and also provides an axis for the invention 10 to rotate about. The rod 40 is attached to wing 20 preferably by three U-clamps 25 (see FIGS. 2, 4, 5, and 7), one in the center and two on the ends of wing 20. Rod 40 is also preferably tack-welded or attached by hook and loop fasteners to wing 20 in four equally spaced locations to prevent the rod from rotating relative to wing 20 (as seen in FIG. 4).

The ends of rod 40 extend a short distance past the ends of wing 20. This overhang or extension of rod 40 allows a bearing assembly 50 to be placed on the ends of the rod. Bearing assembly 50 comprises a three-hole bearing 52. The bearing 52 can be made of any suitable material, but is preferably flexible plastic. The bearing is preferably a flat, rectangular shape having three equally spaced, linear holes. The center hole of bearings 52 is placed on the ends of rod 40. Bearings 52 are prevented from sliding off rod 40 by end caps 54.

Figures 12, 13, 14:
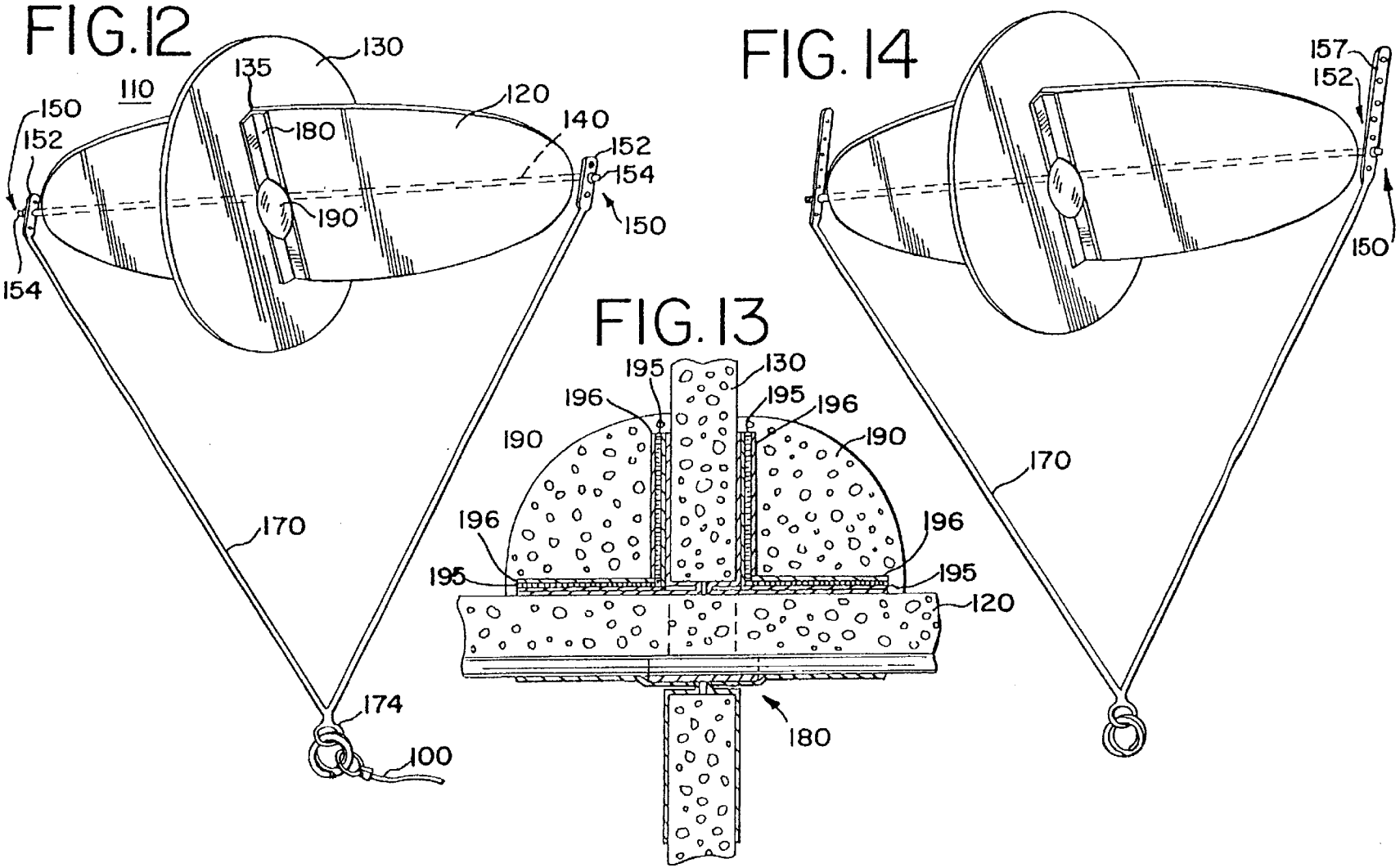
FIG. 12 is a perspective view of an alternate embodiment of the present invention in its flying position.
FIG. 13 is a cross-sectional view of the intersection of the airfoil and stabilizer disk of the alternate embodiment of FIG. 12.
FIG. 14 is an alternate embodiment of the bearing assembly of the present invention.
Figure 15:
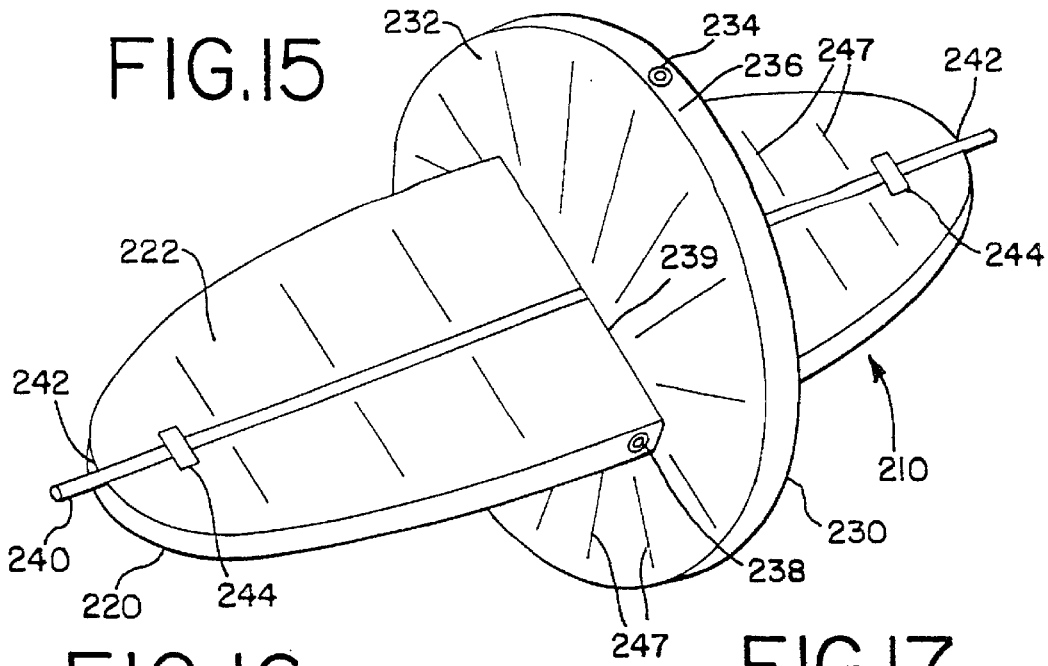
FIGS. 15–18 depict an inflatable embodiment of the present invention.
Figure 16:
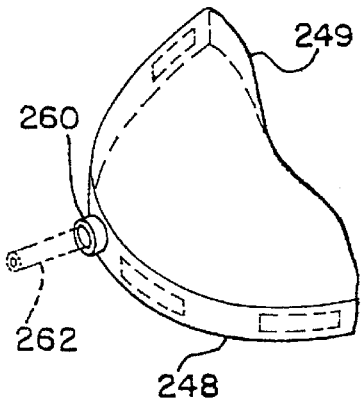
Figure 17:
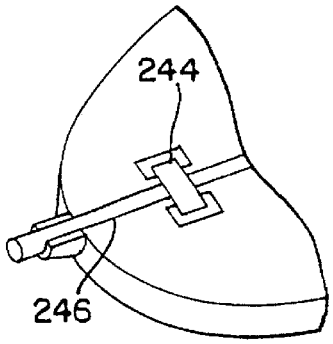
Figure 18:
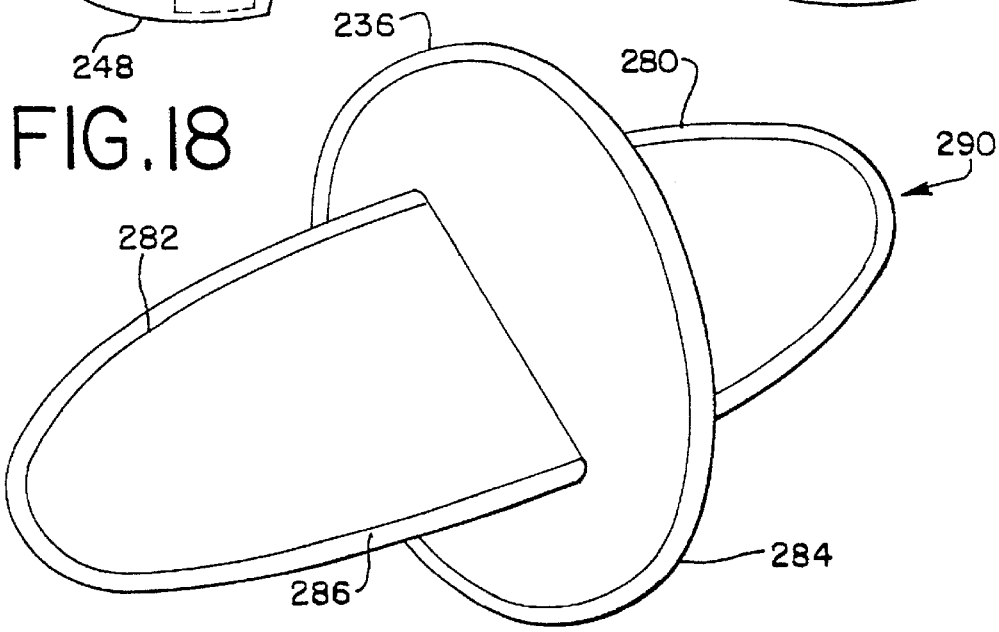

Connected to either of the outer two holes of the three-hole bearing 52 is one end of a bridle 70. Bridle 70 preferably ends in a loop 72 to which a split ring 74 is attached. Kite line 100 is then connected to the split ring 74 on loop 72 of bridle 70. Line 100 is preferably fishing line which is strong yet hard to see, so that invention 10 appears to be floating in the air by itself. Further, as the fishing line vibrates from the rotation of invention 10 and from the wind, the line makes a noise giving the invention 10 an eerie appearance to an observer. Connected to the other of the outer two holes, by suitable connectors 62, preferably a split ring or a swivel clip, is an attachment such as streamer 60. Tubular member 65 is provided to prevent the streamer 60 from becoming entangled with the other parts of the invention 10. In an alternate embodiment, the bearings 52 and bridle 70 are an integral, one piece, stamped V-bridle as illustrated in FIG. 12.

Figure 2:
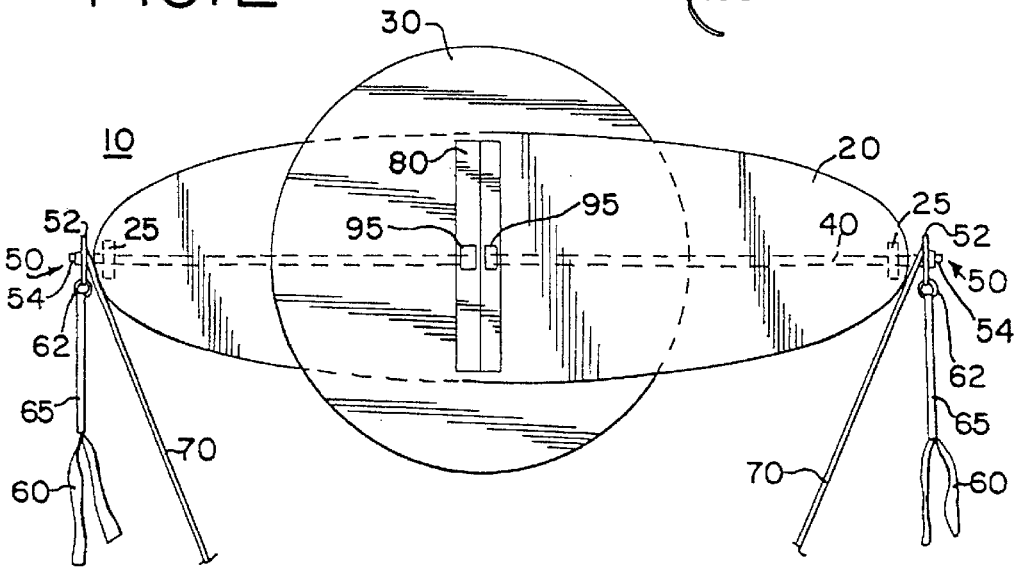
FIG. 2 is a top view of the present invention in its folded position.

FIG. 2 illustrates the non-inflatable embodiment of the present invention 10 in its folded position. Blockers 90 have been removed, thereby allowing for the movement of disk 30 about the double hinge formed by tape 80. Disk 30 is rotated in either direction until coming into contact with wing 20. Invention 10 is thus easily transportable or storable, taking up far less space than a normal rotatable kite.

FIG. 2 also illustrates rod 40, U-clamps 25, bearing assemblies 50 comprising three-hole bearings 52, and end caps 54, streamers 60, connectors 62, tubular members 65, bridle 70, and fastening material 95.

Figure 3:
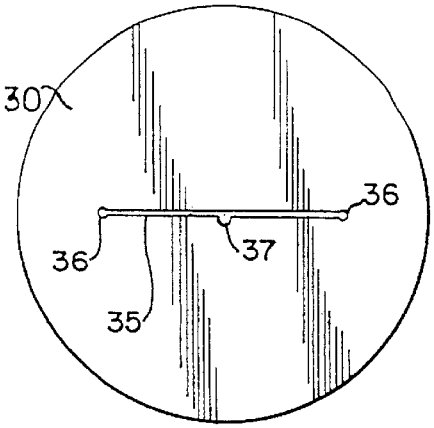
FIG. 3 is a side view of the stabilizer disk of the present invention.

FIG. 3 illustrates stabilizer disk 30 having slot 35 at the center thereof. Slot 35 is of sufficient length to allow for the insertion of wing 20. The ends 36 of slot 35 are over-cut in a circular fashion to allow for slight deformations in disk 30 when in its folded position, thereby preventing disk 30 from tearing at the slot ends 36. The center of slot 35 contains notch 37 to make room for rod 40 and U-clamp 25 to be inserted therein. Ends 36 may be reinforced or repaired by applying glue or tape around its inside edges.

FIG. 4 illustrates airfoil or wing 20. Rod 40 is fictionally held to wing 20 by U-clamps 25. However, rod 40 may additionally be tack-welded or glued with an adhesive or connected by hook and loop fasteners or other suitable attachment means 45 to prevent rotation of the rod. Bearing assemblies 50 are attached on the ends of rod 40. Bearings 52 are prevented from leaving rod 40 by caps 54. Bearings 52 are prevented from contacting wing 20 by tubular spacers 56 placed on the ends of rod 40.

Figure 4A:
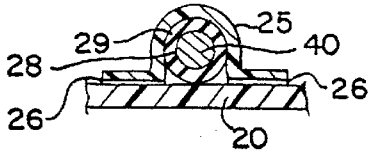
FIG. 4A is a cross-sectional view of a U-clamp of the present invention taken along line 4A—4A of FIG. 4.

FIG. 4A illustrates how the U-clamps 25 are attached to wing 20. U-clamp 25 has stick pads or adhesive 26 attached to its horizontal flanges. U-clamp is placed over rod 40 and pressed down on wing 20 such that stick pads 26 adhere to wing 20, thereby securely holding rod 40 in place on wing 20. Preferably, rod 40 is first wrapped with a resilient foam rubber material 28 before U-clamp 25 is placed thereover. Material 28 has a width equal to that of the U-clamp 25 and is of sufficient length to wrap around rod 40 at least one full time. The inner surface 29 of material 28 includes an adhesive so that material 28 is securely fastened to dowel rod 40 when U-clamp 25 is placed thereover. The use of resilient foam rubber material 28 is desired so that if rod 40 cracks or breaks, the rod 40 can be removed from U-clamp 25, and a new rod inserted therethrough, without the need for the U-clamp to be removed. Attachment means 45 (FIG. 4) are preferably hook and loop fasteners to allow the rod 40 to be instantly repairable.

Figure 5:
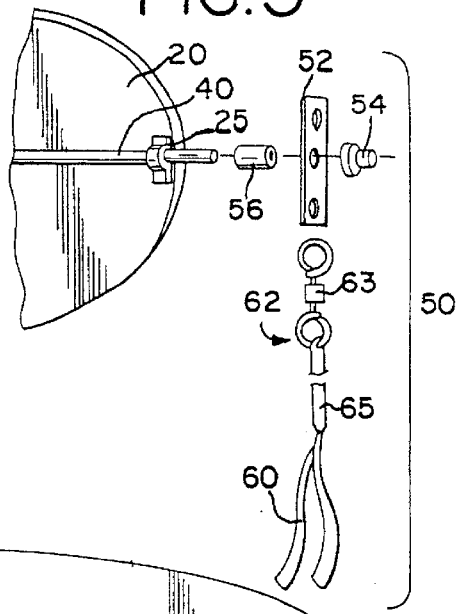
FIG. 5 is an exploded perspective view of the three-hole bearing assembly of the present invention.
Figure 9:
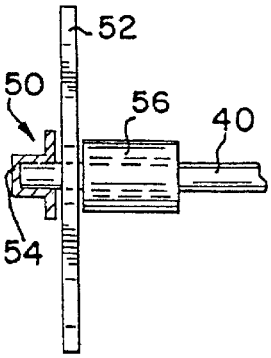
FIG. 9 is an enlarged side view of the three-hole bearing assembly of the present invention.

FIG. 5 illustrates bearing assembly 50 attached to an end of rod 40. Bearing assembly 50 consists of three-hole bearing 52, cap 54, and spacer 56. Spacer 56 is an extruded vinyl tube which is placed on the end of rod 40 and fits snugly thereto. Spacer 56 is placed as far onto rod 40 as possible, i.e., until contacting wing 20. Spacer 56 is of sufficient length to allow the end of rod 40 to extend therefrom. The center hole of three-hole bearing 52 is next placed over the end of rod 40. Cap 54 is then placed on the end of rod 40. The distance between spacer 56 and cap 54 should be sufficient to allow bearing 52 to freely rotate on rod 40 (as seen in FIG. 9). Streamer 60 is attached to an outer hole of three-hole bearing 52 by connector 62, illustrated in FIG. 5 as a swivel 63, preferably a snap swivel. Tubular member 65 holds the streamer 60 away from, and prevents tangling with, the other parts of the invention 10.

Figure 6:
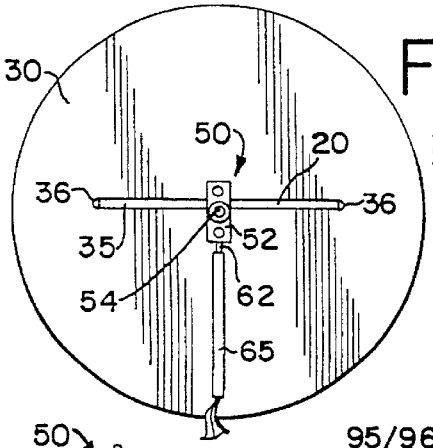
FIG. 6 is a side view of the present invention in its flying position.

FIG. 6 is a side view of invention 10 illustrating disk 30 having slot 35 with over-cut slot ends 36, wing 20 inserted in slot 35, bearing assembly 50 having bearing 52 and cap 54, streamer 60 attached to bearing 52 by connector 62, and tubular member 65.

Figure 7:
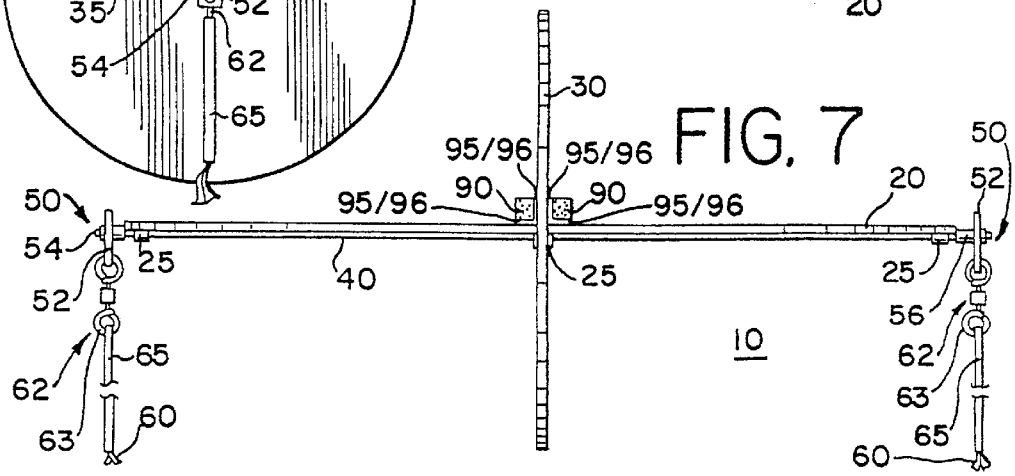
FIG. 7 is a front view of the present invention in its flying position.
Figure 20:
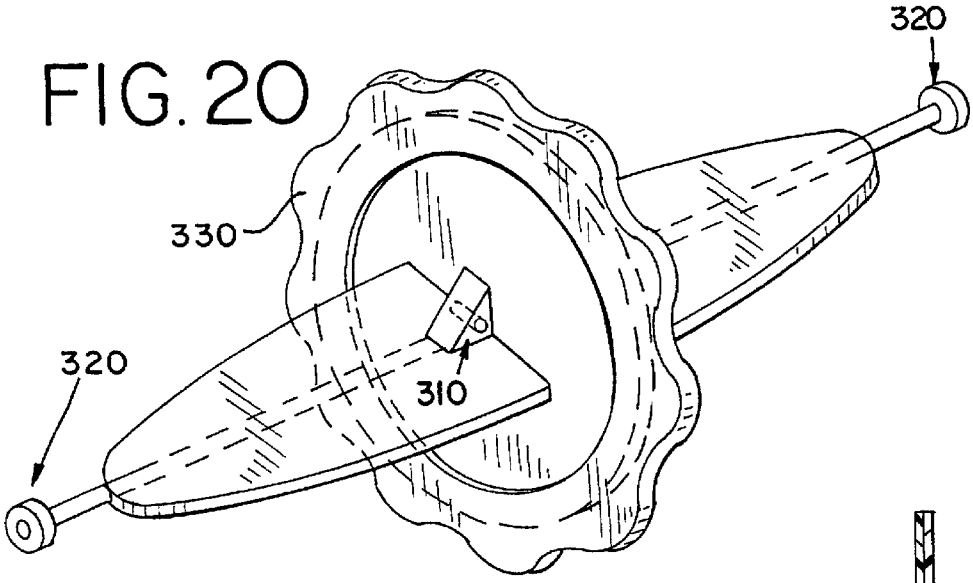
FIG. 20 is a perspective view of the present invention having alternate illuminating means, and noise makers, attached thereto.

FIG. 7 is a front view of invention 10. Wing 20 is inserted through disk 30 with disk 30 being centered thereon. Rod 40 is held on one side of wing 20 by three U-clamps, one in the center, resting in notch 37 of slot 35 of disk 30, and two on the ends of wing 20. Four pieces of fastening material 95 are placed perpendicularly at the intersection, on the side opposite rod 40, two on disk 30 and two on wing 20. Four pieces of complimentary fastening material 96 are placed perpendicularly on blockers 90 (two pieces on each blocker). Blockers 90 are then fastened to the intersection to hold disk 30 in a flying position and are removable to allow disk 30 to rotate to a folded position. Blockers 90 are illustrated as two elements disposed on the same side of wing 20. However, the blockers could be diagonally opposed or four blockers could be used, one in each quadrant of the intersecting wing and disk. Further, blockers 90 could be spherical as illustrated in FIGS. 12 and 13, or triangular as illustrated in FIG. 20.

Bearing assemblies 50 are attached to the ends of rod 40. Spacers 56 are inserted over rod 40 until contacting wing 20. Three-hole bearings 52 are next inserted over rod 40. Caps 54 are then placed on the ends of rod 40. A connector 62, preferably swivel 63, connects streamers 60 to three-hole bearings 52. Tubular members 65 prevent streamers 60 from becoming entangled with bearing assemblies 50.

Figure 8:
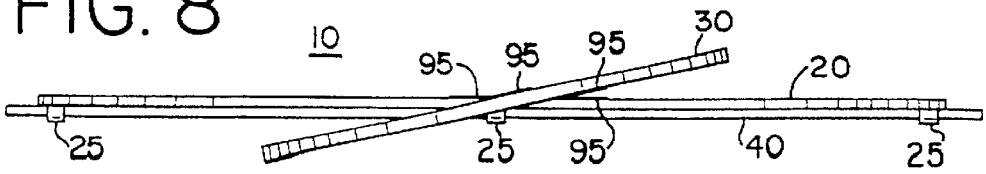
FIG. 8 is a side view of the present invention in a partially folded position.

FIG. 8 illustrates the foldability of stabilizer disk 30. When the blockers 90 of FIG. 7 are removed, disk 30 is free to pivot in either direction about the double hinge formed by tape 80, until disk 30 contacts wing 20. As can be seen, the two pieces of fastening material 95 on one side of disk 30 become folded on top of each other, while the two pieces of fastening material 95 on the other side of disk 30 become substantially linear.

FIG. 9 is a close-up side view of the bearing assembly of the present invention. Spacer 56 is inserted over the end of rod 40. Bearing 52 is next placed onto rod 40 through the center hole of bearing 52. A cap 54 is then placed on the end of rod 40. As can be seen, cap 54 and spacer 56 are sufficiently spaced apart such that bearing 52 is free to rotate on rod 40 in the space provided between cap 54 and spacer 56.

FIG. 10 illustrates how tape 80 forms the double hinge at the intersection of the disk 30 and wing 20. Six pieces of tape 80 are preferably used to form the double hinge. Two long pieces 82 of tape 80, substantially of length equal to the width of wing 20, are placed on the side opposite the rod 40. Disk 30 is first rotated in one direction until it contacts wing 20. A long piece 82 of tape 80 is placed at the intersection, half on wing 20 and half on disk 30. Disk 30 is then rotated in the other direction until it again contacts wing 20. A second long piece 82 of tape 80 is placed at the intersection, half on wing 20 and half on disk 30. The two long pieces 82 of tape 80 should connect at the intersection, underneath slot 35.

Four short pieces 84 of tape 80, substantially of length equal to one-half the width of wing 20, are placed in a similar fashion on the side of wing 20 having rod 40, two short pieces 84 of tape 80 on each side of rod 40. When in place, the four short pieces 84 of tape 80 resemble the two long pieces 82 of tape 80 but having a gap therein for the rod 40 and U-clamp 25.

Four pieces of fastening material 95 are placed on the long pieces 82 of tape 80 at the center of the intersection. The pieces of fastening material 95 are placed, two on each side of disk 30, so that they are perpendicular when disk 30 is in flying position. It should be understood that eight pieces of fastening material 95 would be used if four blockers were being used.

Complimentary fastening material 96 is placed on perpendicular sides of blockers 90. When blockers 90 are in use, fastening material 95 and 96 coact to hold the blockers 90, and thus disk 30 in position.

Figure 11:
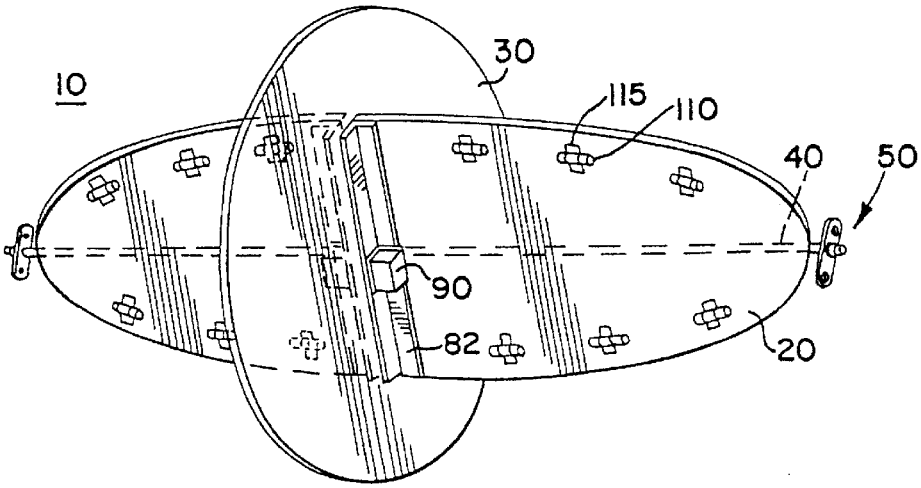
FIG. 11 is a perspective view of the present invention having illuminating means attached thereto.

FIG. 11 shows the present invention 10 with illumination means such as a plurality of neon light tubes 110 suitably attached to wing 20 by attachment means such as U-clamps 115. The illumination means can be placed on the edges of disk 30 and wing 20 so that the invention 10 is outlined as it rotates in the dark.

Figure 19:
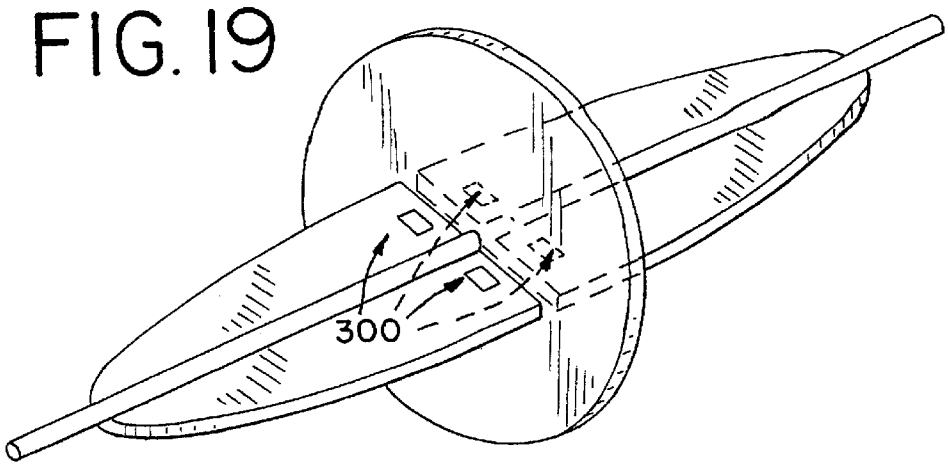
FIG. 19 is a perspective view of the present invention having batteries to power noise makers and/or illuminating means attached thereto.

However, the invention 10 can be painted, decorated or illuminated in any suitable manner. For example, silver tape may be added as a decoration or to reflect radar or light, as shown in FIG. 20. Such tape could also be applied for extra rigidity to the wings, especially where the wings have cracked or broken and have been glued together. A number of L.E.D.'s may be stuck into the wing 20 or disk 30. A battery could be provided to light the L.E.D.'s, as shown in FIG. 19.

FIG. 12 shows an alternate embodiment of the invention 110 having wing 120 and disk 130. Wing 120 is oval-shaped and is inserted through slot 135 on disk 130. Disk 130 is centered on and perpendicular to wing 120 in a flying position. Disk 130 is anchored to wing 120, at their intersection, by connecting means 180, preferably nylon tape. Tape 180 is placed along all four quadrants of the intersecting wing 120 and disk 130 to form a double hinge (as seen in FIG. 13). Disk 130 is free to rotate about this double hinge until prevented from doing so by contacting wing 120. To keep disk 130 from rotating during flight, and maintaining a perpendicular orientation to wing 120, a plurality of stabilizing elements or blockers 190 are used. Blockers 190 are illustrated as quartered spheres (as will be described in more detail with reference to FIG. 13).

A wooden rod 140 is centered on and attached to wing 120 by a plurality of U-shaped clamps. The ends of rod 140 extend a short distance past the ends of wing 120. This overhang or extension of rod 140 allows a bearing assembly 150 to be placed on the ends of the rod. Bearing assembly 150 comprises an integral, one piece, stamped, three-hole bearings 152 and V-bridle 170. Integral bearings 152 are preferably a flat rectangular shape having three equally spaced, linear holes. The V-bridle 170 is integrally connected to and extends from one end of the bearings 152. The center hole of bearings 152 is placed over the ends of rod 140. A simple twist must be imparted to the integral bearings 152 so that the hole can be aligned with rod 140. Bearings 152 are prevented from sliding off rod 140 by end caps 154.

Integrally attached to one end of the three-hole bearings 152 is bridle 170. Bridle 170 ends in an integral ring 174. Line 100, preferably fishing line is attached to ring 174 of bridle 170 by a connector ring. Alternatively, line 100 could be directly attached to integral ring 174. The integral V-bridal, stamped from plastic or other suitable materials, allows the kite line to always be attached at the center of the V-bridal and thus eliminates any error in judging the center, resulting in lopsided and/or diminished flight. A streamer similar to that illustrated in FIG. 1, can be connected to the outer hole of bearing 152 opposite bridle 170, by suitable connectors. Should bridle 170 happen to break, the bridle 170 can be cut at the bearings 152 and a bridle 70 can be attached as described in invention 10.

FIG. 13 is a cross-sectional view of the intersection of the airfoil 120 and stabilizer disk 130 of the invention 110. As can be seen, blockers 190 are illustrated as two quartered spheres which when placed together form a half sphere. Tape 180 is placed along the intersection of disk 130 and wing 120 to from the double hinge in the same manner as described before.

Four pieces of fastening material 195 are placed at the center of the intersection, two in each upper quadrant, perpendicular to each other as described in FIG. 10. The fastening material 195 is preferably hook and loop fasteners, which are placed on wing 120 and disk 130 on the side opposite rod 140. If four spherical blockers are used, fastening material 195 on the side with rod 140 can be placed off center, or preferably split into two and placed on both sides of rod 140. Each quartered spherical blocker has two planar sides, one which abuts wing 120 and one which abuts disk 130. Each planar side has a recessed portion for receiving complimentary fastening material 196. The recessed portions are cut as deep as the thickness of fastening material 195 and 196 when placed together, such that the planar sides are flush with wing 120 and disk 130. If four blockers are used, the blockers on the side with rod 140 also contain a groove for receiving rod 140 therethrough.

Additionally, for extra strength and stability, a connector can be placed through disk 130 on one or both sides of wing 120, into quartered spherical blockers 190 to securely attach the blockers 190 together. The connector can be any suitable connector such as a cylindrical pin or screw member. Quartered spherical blockers 190 thus securely and removably provide strength and stability, as well as being aesthetically pleasing and aerodynamic.

Figure 23:
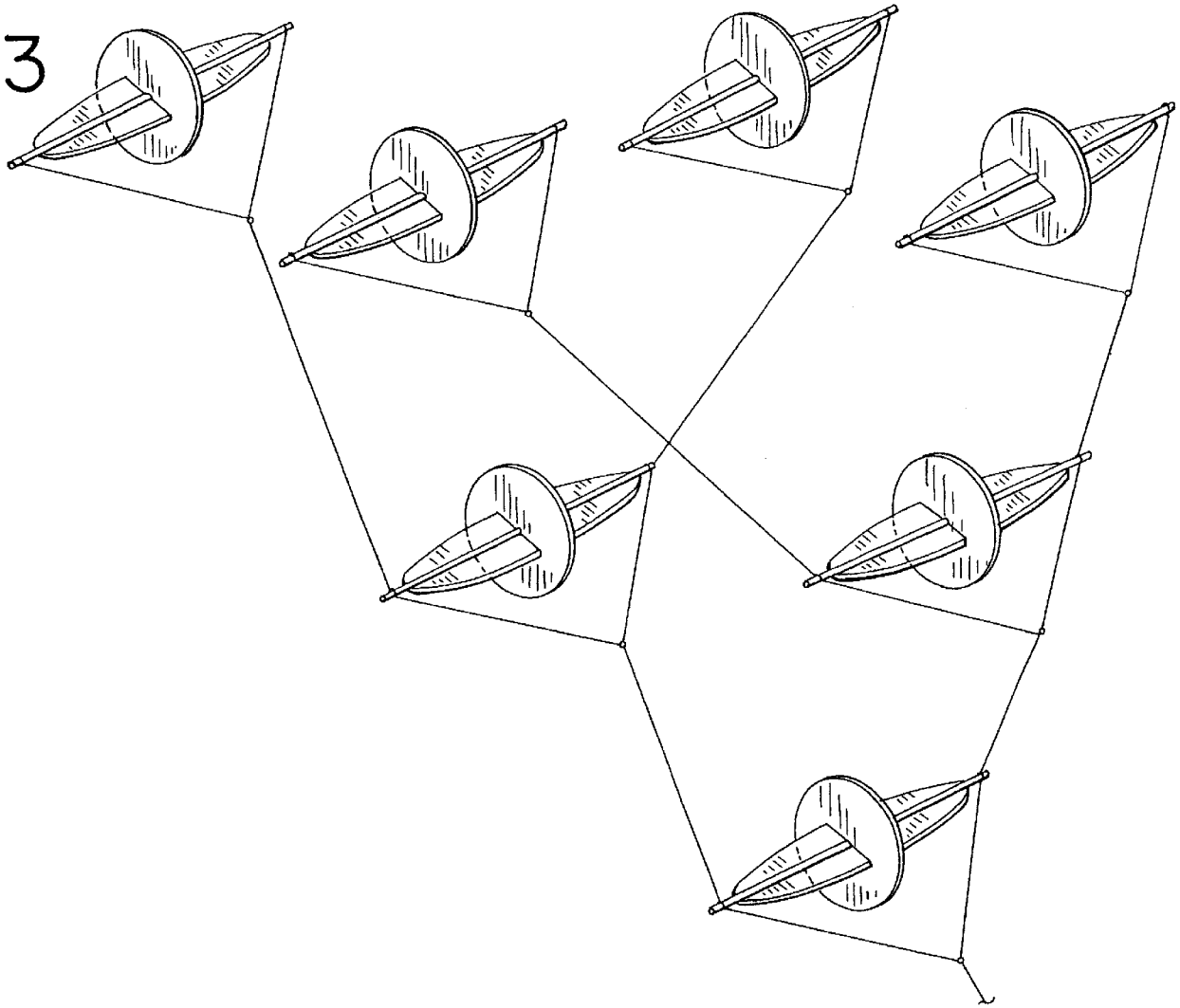
FIG. 23 is a schematic view of a multiple kite arrangement of the present invention.

FIG. 14 illustrates an alternate embodiment of the integral bearing assembly and V-bridal 150/170 of FIG. 12. In this embodiment, bearing 152 of bearing assembly 150 comprises an integral extension 157 at its free end. A plurality of holes are provided in extension 157. In use, since extension 157 extends a distance away from rod 140 and wing 120, a streamer can be attached directly thereto, without the use of a tubular member as described above. Further, additional attachments could be made, in addition to the streamer. For example, additional kites can be linked together as shown in FIG. 23. Also, noise makers such as bells and/or whistles could be attached via any of the unused bearing holes. Alternatively, noise makers can be suitably attached directly to the kite, including in the blockers or on the ends of the dowel rod as illustrated in FIG. 20.

Rod 140 could also be positioned in any of the plurality of holes. When in use with a streamer, rod 140 is preferably positioned in the first or second hole adjacent V-bridle 170. However, when the present invention is flown without streamers or other attachments, rod 140 is preferably positioned at the hole adjacent the free end of extension 157.

To assemble the above described non-inflatable embodiment of the present invention 10, disk 30 is placed over and centered on wing 20. Rod 40 is placed along the longitudinal axis of wing 20. Three U-clamps are placed over rod 40 and attached to wing 20, one at the center and two at the ends. Rod 40 may be tack welded to wing 20 so that rod 40 cannot spin. Four equally spaced welds along rod 40 may be desirable. Smaller sized U-clamps could be used to achieve a similar result.

Tape 80 is next added to the intersection of wing 20 and disk 30 to form the double hinge. Fastening material 95 is then placed on long pieces 82 of tape 80.

Next, the bearing assemblies 50 are attached to the ends of rod 40, one on each end. Spacers 56 are placed over the ends of rod 40, followed by bearings 52 (center hole), and caps 54. The ends of the bridle 70 are tied directly to or suitably connected to an end hole of each of the three-hole bearings 52.

Streamers 60 are attached to the remaining end hole of the three-hole bearings 52. Streamers 60 can be of any length and any material but are preferably made of nylon. The streamer 60 is first looped somewhere along the length of the streamer 60. The loop is then fed through the tubular member 65 in any suitable manner such as pulling it through with a crochet needle or a string. The tubular member 65 can be any suitable tubular member such as a straw. The connector 62, for example a swivel or a split ring, is connected to the end of the loop formed in the streamer 60.

The loop is then tied in a knot and the tubular member 65 is slid all the way up to the connector 62. The knot should be inside the tubular member 65 and should provide proper friction to hold the tubular member 65 in place. The connector 62 is then attached to the end hole of the bearing 52. The invention 10 is now ready to be flown, however, the invention 10 may be flown without the streamer 60 if desired. Also, streamer 60 can be tied directly to an end hole of bearing 52, however this would hamper efforts to attach and detach as desired. Blockers 90 with complimentary fasteners 96 are added for stability. Invention 110 is assembled in a similar manner.

It has also been found advantageous to provide an inflatable kite 210 as depicted in FIGS. 15–18. This inflatable embodiment 210 of the present invention presents a wing 220 and a disk 230 as with the previously described embodiments. However, in the present embodiment 210, the wing 220 and the disk 230 are each comprised of an inflatable body comprising a preformed skin 222, 232. The inflatable skins 222,232 are preformed to be air impermeable at all portions thereof except a port 234 located at an outer diameter 236 of the disk 230.

In a preferred embodiment of the inflatable kite 210, the wing 220 and disk 230 are attached one to the other. Consequently air is allowed to pass freely from the inside of said wing 220 to said disk 230. In this manner, the entire kite 210 may be inflated or deflated via the port 234 located on the disk 230. In an alternate embodiment of the inflatable kite 210, the wing 220 and the disk 230 are distinct bodies. Consequently, neither is in fluid communication with the other. Necessarily, therefore, the wing 220 is provided with a port 238 to allow inflation and deflation thereof. In this embodiment, the wing 220 may be attached to the disk 230 such that said wing 220 and disk 230 are always connected. Alternatively, the wing 220 and disk 230 could be distinct pieces. When the kite 210 employs a distinct wing 220 and disk 230, a hole 239 must be provided in the disk 230 to allow insertion of the wing 220 therein. Preferably, the wing 220 and disk 230 may be held together via friction created between said wing 220 and disk 230 when said wing 220 is inflated in said disk 230.

As with prior embodiments, inflatable kite 210 employs a rod 240 extending along the length of the wing 220 and beyond each end 242 of said wing 220. The rod 240 preferably is held to the wing 220 by at least one holding mean 244. The relation between the rod 240 and the rest of the kite 210 will therefore be the same as in the above embodiments. Alternatively, the wing 220 could comprise an elongated grove 246 extending between the ends 242 of said wing 220. In this manner, the at least one holding means 244 would merely extend over the top of the groove 246. However, when said wing 220 employs the elongated groove 246, the rod 240 may be held within said groove 246 solely by the friction created by the contraction of the groove around the rod 240 when said wing 220 is inflated. To protect the skin 222 of said wing 220, a vinyl fabric sleeve preferably surrounds the rod 240. In this manner, rod 240 may comprise a simple wooden rod. However, the sleeve is preferably formed from any material which will prevent puncture of the wing 220 in the event of said rod 240 breaking.

Whether said wing 220 and said disk 230 are constructed of a single piece or distinct units, the resulting kite 210 presents a kite with all the flying advantages discusses above for the non-inflatable embodiment as well as transportation advantages. The kite 210 may be inflated or deflated via ports 234, 238. When deflated, the kite 210 will comprise outer skins 222, 232 and the rod 240. In this configuration, the skins 222, 232 may simply be wrapped around the rod 240 and carried to the desired destination.

To inflate the present kite 210, air need simply be injected into the ports 234, 238. When inflated, kite 210 presents a rigid body consistent with the other embodiments presented above. To increase the rigidity of the present kite 210, it has been found advantageous to place ribs 247 along said wing 220 and said disk 230. Various placement sizes and shapes of said ribs 247 are contemplated to increase the rigidity of said wing 220 and said disk 230.

A cap 248 may optionally be placed on each end 242 of said wing 220. Said cap 248 are preferably connected onto said wing ends 242 by a means such as glue or hook and look type connection system. However, other connections are also contemplated. Alternatively, the cap 248 may be held onto said wing end 242 by friction created by the expansion of said wing 220 between sidewalls 249 of said cap 248 when the wing 220 inflates to its fully inflated configuration. The cap 248 assists use of a bearing assembly (not depicted with the inflatable embodiment) consistent with the non-inflatable uses of bearing assembly 50. Said cap 248 presents an extension 260 on which said bearing assembly may rest. Specifically, a bearing (not depicted with the inflatable embodiment) may be in contact with said extension 260 and allow rotation between said extension 260 and said bearing. Alternatively, a spacer (not depicted with the inflatable embodiment) may be placed on said rod 240 on which said bearing may rest. In an alternative embodiment, the cap 248 may present a rod extension 262 on which to hook said bearing assembly and a bridle (not depicted with the inflatable embodiment) for attachment thereto consistent with the above non-inflating embodiments. It should be noted however that the inflatable kite of the present invention employing cap 248 may operate without the rod extension 262. The necessity of rod 240 is thereby eliminated.

Alternatively, kite 210 is provided with a small wing pocket 280 surrounding an outer circumference 282 of said wing 220 and a small disk pocket 284 surrounding the outer diameter 236 of said disk 230. The small wing pocket 280 and the small disk pocket 284 are configured to allow insertion therein of at least one cage rod 286. Said at least one cage rod 286 will impart additional rigidity to the kite 210 such that the kite 210 may sustain shear forces caused by cross-winds. Said at least one cage rod 286 can be constructed of aluminum, plastic or any other light material suitable as known in the kite art. Alternatively, kite 210 may be comprised of a permanent frame 290 constructed of either a plastic or aluminum, or any other suitable material as known in the art, to provide a permanent outer frame around the circumference of said wing and the outer diameter of said disk 236. The wing and disk comprise their respective skins therebetween.

It should be understood that the bearing assembly, streamers bridle and other portions of the non-inflatable embodiments described above are employable with the present inflatable kite 210.

FIG. 19 illustrates the placement of batteries 300 which can be used to power illuminating means and/or noise makers as described for example with respect to FIG. 11. As illustrated, four batteries 300 are attached to the airfoil near the stabilizer disk. The batteries are equally spaced apart to maintain balance of the kite. The batteries are preferably light-weight, and are attached by any suitable means. It should be understood that any number of batteries could be used, and can be placed anywhere on the airfoil and/or stabilizer disk, so long as balance can be maintained. If necessary, a weight or other attachment can be added where necessary to balance or counterbalance the weight of a battery or batteries. The lights and/or noise makers can be electrically connected to the batteries via wires or any other suitable connection.

FIG. 20 illustrates an alternate embodiment of the illuminating means, as well as the noise makers of the present invention. As can be seen, the noise makers can take any suitable form and can be placed anywhere on the kite. Preferably, a whistle 310 is placed in the blocker (triangular blocker illustrated) When the kite rotates, air passes through the whistle to cause a noise. Any suitable whistle that makes noise when air passes therethrough or therearound, can be used, as is known in the art of noise making. Alternatively, a noise maker 320 can be placed elsewhere on the kite, balancing the kite when necessary, such as on opposite ends of the dowel rod. Noise maker 320 can take the form of a bell, a whistle, or even a speaker which could output sounds from any suitable transmitter.

As further seen in FIG. 20, an illuminating means 330 in the form of self adhesive or pressure sensitive silver mylar or other flashy or glow in the dark film, is provided around the perimeter of the stabilizer disk. It should be understood that any suitable shiny, flashy, or illuminous material can be suitable attached as described herein around the perimeter of the disk or airfoil or elsewhere on the kite. The loose, uneven or nonuniform ends of the mylar extending around and beyond the disk would catch and reflect more light and provide a wavy, flashy appearance to the kite when in use.

Figure 21:
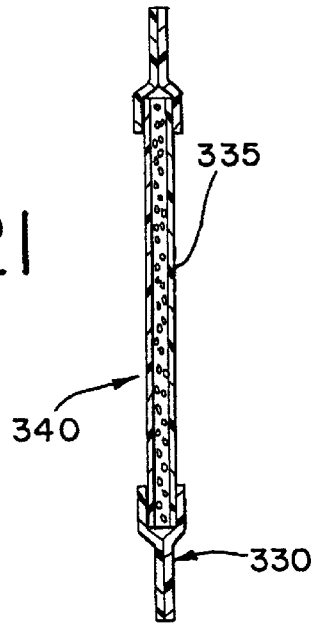
FIG. 21 is a cross-sectional view of the alternate illuminating means of FIG. 20.
Figure 22A:
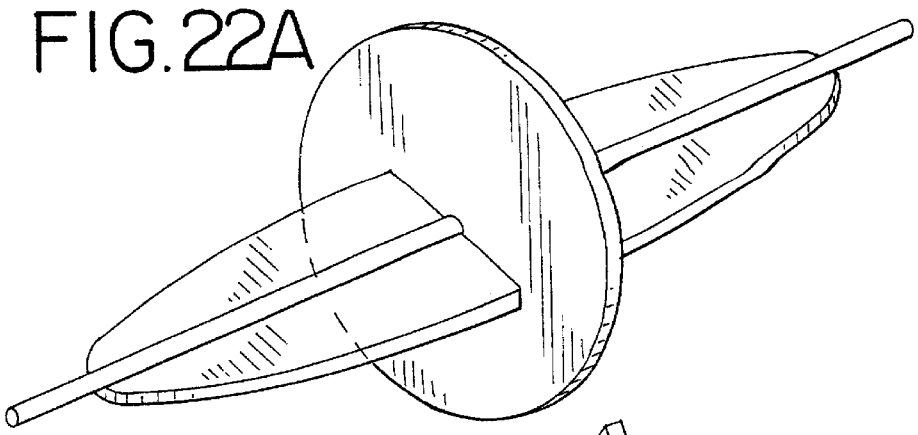
FIGS. 22A–22J are perspective views of the present invention taking various shapes.
Figure 22B:
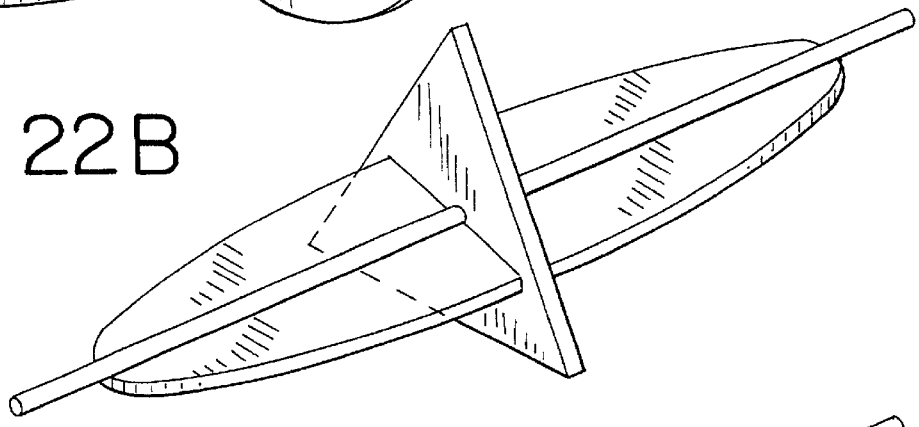
Figure 22C:
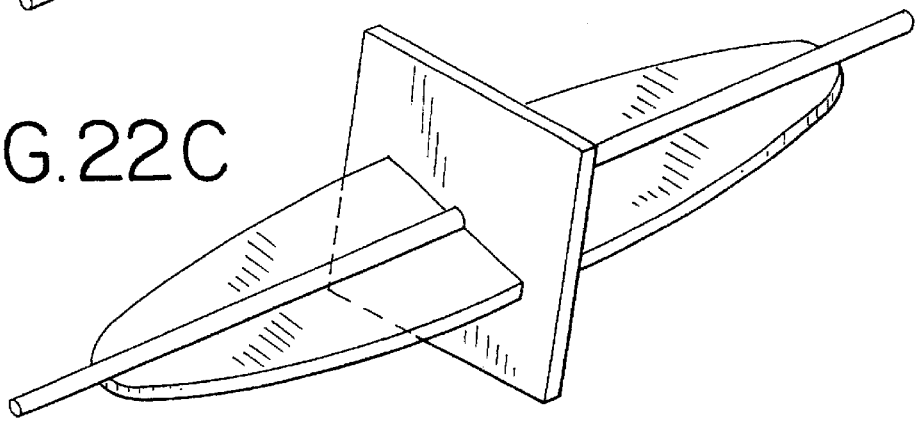
Figure 22D:
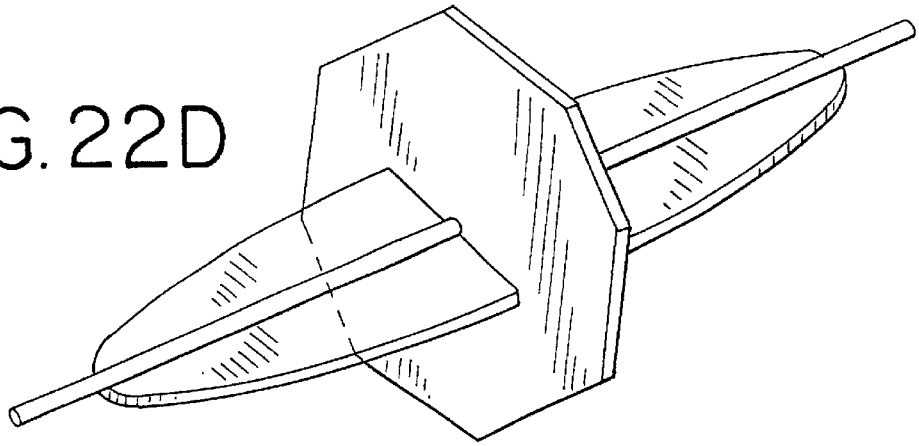
Figure 22E:
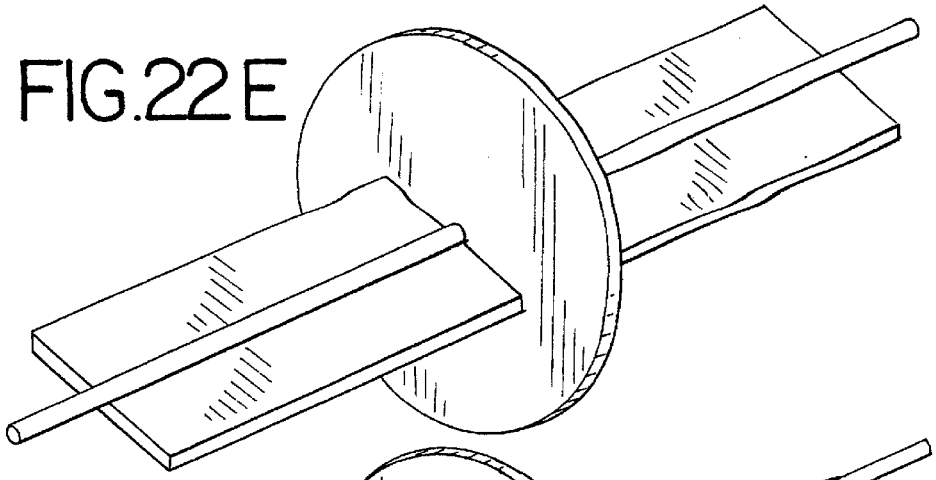
Figure 22F:
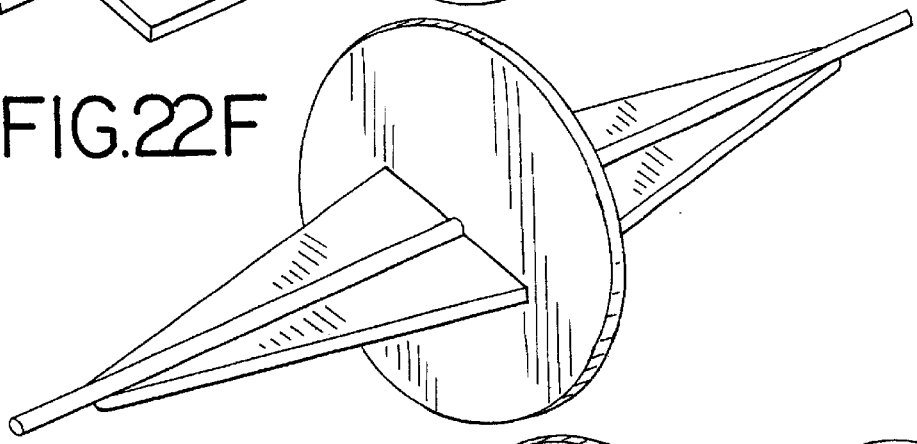
Figure 22G:
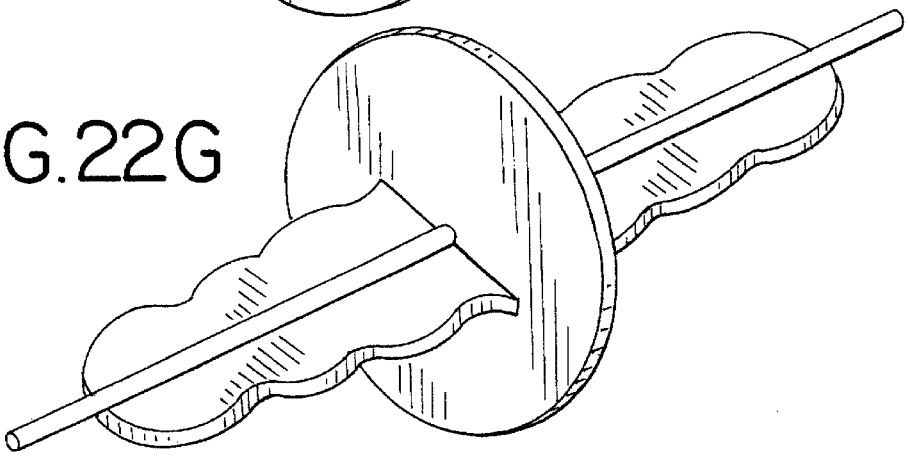
Figure 22H:
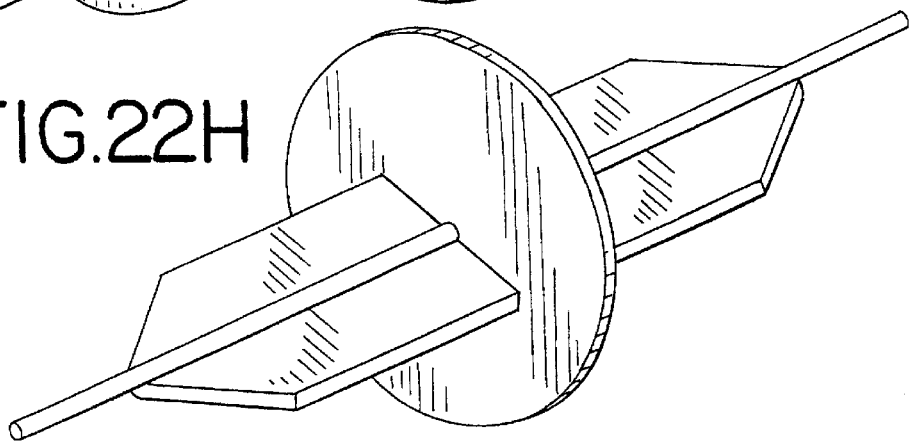
Figure 22I:
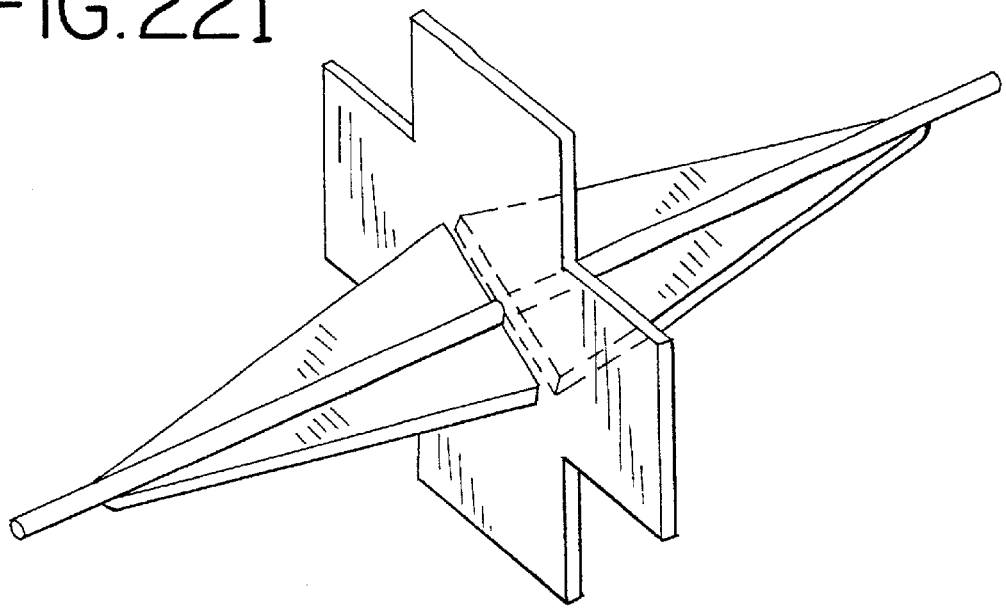
Figure 22J:
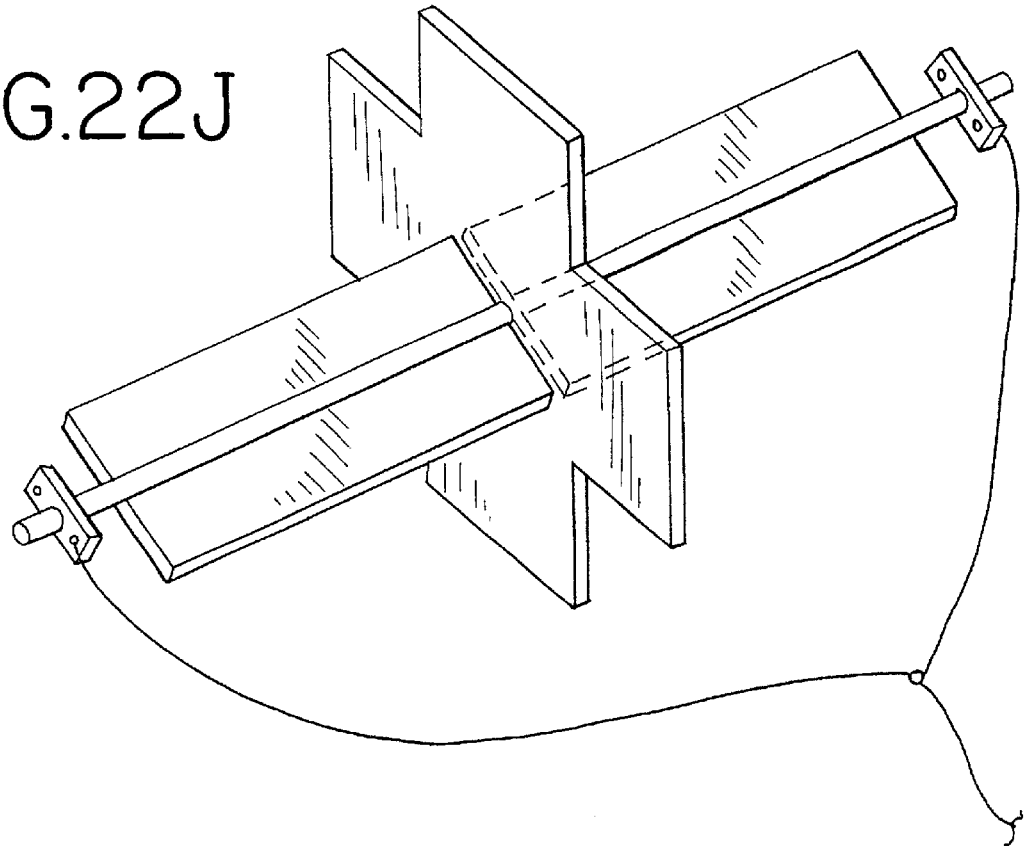

FIG. 21 is a cross section of the disk of FIG. 20. As can be seen, mylar 330 is attached around the perimeter of the disk. The disk can be formed of beaded foam 335 and have a suitable coating or film 340 thereover. The mylar 330 further protects the edges of the disk.

FIGS. 22A–22J illustrate various shapes that the kite could take. In general both the airfoil and the disk can take various geometric shapes, so long as the kite is suitably balanced when flown. For example, the stabilizer disk can be circular in FIG. 22A, triangular in FIG. 22B, square in FIG. 22C, or octagular in FIG. 22D. The airfoil can be rectangular in FIG. 22E, diamond shaped in FIG. 22F, wavy in FIG. 22G, or hexagonal in FIG. 22H. Combined shapes can be used such as a cross shaped disk and diamond shaped airfoil or rectangular airfoil as in FIGS. 22I and 22J, respectively. Other combinations are foreseen.

FIG. 23 illustrates a multi-kite embodiment wherein multiple kites are linked together by attaching additional bridles to the bearings. Conceivably, any number of kites can be linked in this manner so long as they provide balance and will not become entangled.

To fly the invention 10, a user, while facing another user holding the end of the kite line, only needs to hold onto the ends of wing 20 and flip it up over his head into the wind, while the other user holds onto the kite line. The wind will lift the kite into the air as the kite rotates about the axis of rod 40.

The invention has been illustrated as having one stabilizer disk. However, it is foreseen that the novel characteristics of the present invention can be applied to an airfoil having two or more stabilizer disks. Also, the invention can be flown with noise makers attached as described herein. For example, bells could be attached to the end of V-bridle, or whistles could be attached on the streamers or elsewhere on the kite including in the blockers or on the dowel rod. Further, the stabilizer disk has been illustrated as being held in flying position by blockers. However, it is foreseen that the disk could be held in place by a plurality of hook and rubber bands connecting the ends of the wing in each quadrant, or a plurality of grommets and string connecting the ends of the disk to the ends of the wing in each quadrant. The wing and disk could also be glued together. This however would prevent folding of the disk if desired. The kite can take various symmetric shapes.

It is to be understood that the embodiments herein described are merely illustrative of the principles of the present invention. Various modifications may be made by those skilled in the art without departing from the spirit or scope of the claims which follow.

What is claimed is:

1. A rotary flying device comprising:

an airfoil having an axis of rotation means for rotation thereabout;

a stabilizer disk mounted on said airfoil;

means for stabilizing; and means for producing an audible sound, said means for producing an audible sound being located in said means for stabilizing.

2. The device of claim 1, wherein said means for producing an audible sound includes bells, whistles, speakers, or vibrating material.

3. The device of claim 1, further comprising means for illuminating, said means for illuminating are neon light tubes, flashy material, or glow in the dark material.

4. A rotary flying device comprising:

an airfoil having an axis of rotation means for rotation thereabout; and a stabilizer disk mounted on said airfoil;

said airfoil defines a shape and said stabilizer disk defines a shape, wherein the shape of at least one of said airfoil and said stabilizing disk having sides which are rectilinear.

5. The device of claim 4, wherein said shape of said stabilizer disk is triangular, square, octangular, or cross shaped.

6. The device of claim 4, wherein said shape of said airfoil is rectangular, diamond, or hexagonal.

7. The device of claim 4, wherein said shape of said stabilizer disk is triangular, square, octangular, or cross shaped; and said shape of said airfoil is rectangular, diamond, or hexagonal.

8. The device of claim 4, further comprising means for illuminating, said means for illuminating are neon light tubes, flashy material, or glow in the dark material.

9. A rotary flying device comprising:

an airfoil;

a stabilizer disk operatively connected to said airfoil, said stabilizer disk defining a perimeter; and means for protecting said perimeter of said airfoil, said means for protecting said perimeter comprising a film-like material, said film-like material includes a portion extending beyond said perimeter of said stabilizer disk.

10. The device of claim 9, wherein said film-like material is mylar.

11. The device of claim 9, further comprising means for illuminating, said means for illuminating are neon light tubes, flashy material, or glow in the dark material.

12. A rotary flying device comprising;

a first rotary kite having an airfoil, a stabilizer disk, and a bearing assembly including a first bearing means and a second bearing means;

a second rotary kite suitably attached to said first bearing means; and a third rotary kite suitably attached to said second bearing means.

13. The device of claim 12, wherein said second rotary kite and said third rotary kite each include a bearing assembly allowing said second rotary kite and said third rotary kite to attach additional kites thereto.

* * * * *